United States Patent [19]

Dreier

[11] Patent Number: 4,466,369

[45] Date of Patent: Aug. 21, 1984

[54] CONTROL DEVICE FOR THE PRESSER MECHANISM OF A SEWING MACHINE

[75] Inventor: Ernst Dreier, Steckborn, Switzerland

[73] Assignee: Fritz Gegauf Akteingesellschaft Bernina-Nähmaschinenfabrik, Steckborn, Switzerland

[21] Appl. No.: 550,533

[22] Filed: Nov. 10, 1983

[30] Foreign Application Priority Data

Nov. 18, 1982 [CH] Switzerland ..... 6716/82

[51] Int. Cl.[3] ..... D05B 29/00

[52] U.S. Cl. ..... 112/237

[58] Field of Search ..... 112/237, 235, 238, 239, 112/60, 61

[56] References Cited

U.S. PATENT DOCUMENTS

| | | | |
|---|---|---|---|
| 319,766 | 6/1885 | White | 112/237 |
| 1,009,408 | 11/1911 | Hagelstein | 112/239 |
| 1,042,429 | 10/1912 | Green | 112/239 |
| 2,986,105 | 5/1961 | Maxant | 112/237 X |
| 3,661,102 | 5/1972 | Tice | 112/239 X |
| 4,333,407 | 6/1982 | Lerch | 112/237 |

FOREIGN PATENT DOCUMENTS

| | | | |
|---|---|---|---|
| 53542 | 1/1967 | German Democratic Rep. | 112/235 |
| 532150 | 5/1972 | Switzerland | 112/235 |
| 836214 | 6/1960 | United Kingdom | 112/237 |
| 839233 | 6/1960 | United Kingdom | 112/237 |
| 1052592 | 12/1966 | United Kingdom | 112/237 |
| 1164502 | 9/1969 | United Kingdom | 112/237 |
| 1267291 | 3/1972 | United Kingdom | 112/237 |

*Primary Examiner*—H. Hampton Hunter

*Attorney, Agent, or Firm*—Birch, Stewart, Kalasch & Birch

[57] ABSTRACT

A double lever is provided having a forward arm which is operatively connected to a collar of a presser bar and a rearward arm which is connected via a linkage to an operating lever. A guide arm is articulated to the rearward arm and carries an index pin guided within a parallelogram-shaped inherently closed cam route. A spring-loaded swivel arm including a detent catch is associated with the lower cam section of the closed cam route. Upon light pressure being exerted on the operating lever, the detent catch locks the index pin in a position wherein the presser mechanism lies in close proximity to an uppermost lifted position. By additional pressure being exerted on the operating lever, the index pin moves passed the locking position. With the subsequent release of the operating lever, the presser mechanism returns to the lowered position.

5 Claims, 4 Drawing Figures

CONTROL DEVICE FOR THE PRESSER MECHANISM OF A SEWING MACHINE

BACKGROUND OF THE INVENTION

1. Field of the Invention

The invention relates to a control device for the presser mechanism of a sewing machine, with an operating lever activatable in the same direction for lifting and for lowering the presser mechanism. The operating lever is operatively connected to the presser bar via a double level. The double lever is, in turn, operatively connected to a releasable locking mechanism by way of an index member guided in an inherently closed, controlled cam route with associated detent catch.

2. Description of Background Art

In a control device of the type disclosed, for example, in U.S. Pat. No. 4,333,407, dated June 8, 1982, a cam route is fashioned with a detent catch positively engaged by an index member after release of an operating lever when the operating lever is actuated for the first time. Thus, the lifted presser bar remains locked in a lifted position. Only with a renewed actuation of the previously released operating lever is it possible for the index member to leave the detent catch, whereupon the presser bar is again lowered into its operative position, suitably under the effect of a spring.

However, in many instances, it is desirable to place the presser mechanism into its lifted position for a more or less short period of time without locking it into such position. This is impossible by means of the aforementioned device. The engagement of the index member into the detent catch upon release of the first-actuated operating lever necessitates a relatively large rearward movement of the operating lever and a correspondingly large backward stroke of the index member and the presser mechanism. Thus, the presser mechanism is locked in place considerably below its maximum possible lifting height. Therefore, manipulating thick sewing material with the presser mechanism in the locked condition is thus possible only with difficulty.

SUMMARY AND OBJECTS OF THE INVENTION

The present invention, in contrast to the above discussed device, has the purpose of providing a control device for making it possible, on the one hand, to release the locked condition of the presser bar by a further movement of the operating lever in the same direction, without previous rearward movement of the operating lever, and, on the other hand, to lock the presser mechanism in place at a lifting level only slightly below its maximum possible lifting height.

This is attained according to the present invention by providing a detent catch, arranged adjacent to a spring-loaded swivel arm, which projects into the path of movement of an index member directly in front of a turning point of a cam corresponding to the maximum possible lifting position of the presser mechanism. Upon actuation of the operating lever for lifting the presser mechanism, the detent catch receives and seizes the index member guided through the cam route for the purpose of locking the presser mechanism in the corresponding lifted position. While, with a further movement of the operating lever in the same direction, the index member, overcoming the spring force acting on the swivel arm, leaves the receding detent catch toward the turning point of the cam. During the subsequent release of the operating lever, the index member returns automatically to the cam point corresponding to the lowered position of the presser mechanism.

The detent catch which suitably forms an approximately trapezoidal marginal cutout in the swivel arm and which retains the index member in the locked position thus make it unnecessary to move the operating lever backwards so that a simple continued movement of the operating lever, with the application of pressure to overcome the spring biasing the swivel arm, places the index member out of engagement with the detent catch. Thanks to the proximity of the locking point to the turning point in the cam route, it is possible to keep at a minimum the level difference of these points and thus of the corresponding lifting positions of the presser mechanism. In other words, the locking position of the lifted presser mechanism corresponds almost to the maximum possible lifting height of the presser mechanism.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
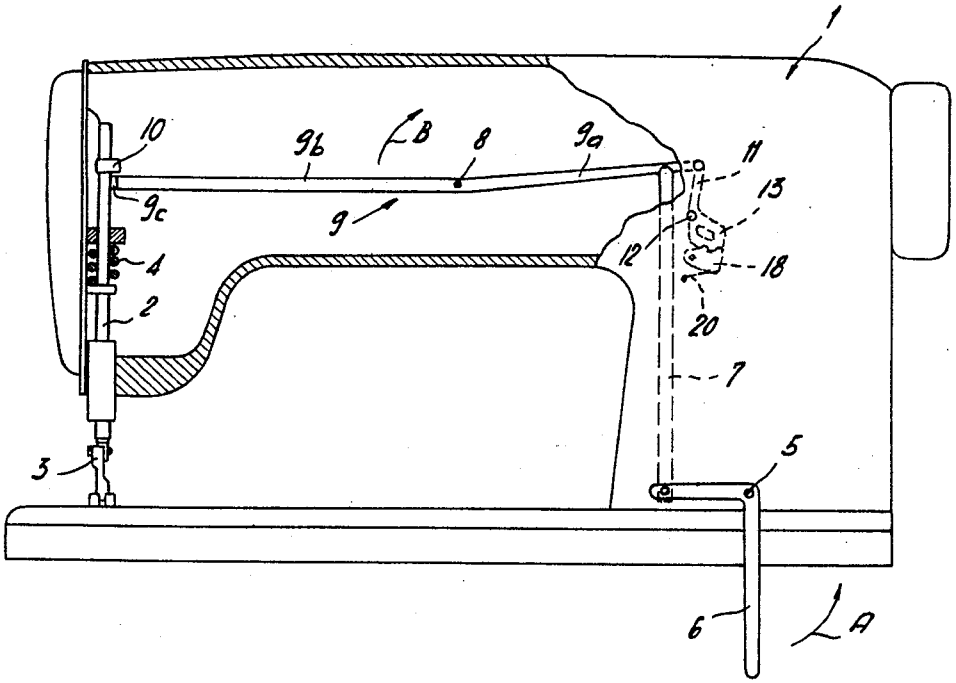
FIG. 1 is a frontal view of the sewing machine, partially cut away, with a schematically illustrated control device.

As illustrated in FIG. 1, a machine housing 1 is provided with a presser bar 2 operatively connected to a presser mechanism 3 and being supported in a pedestal head of the machine housing. The presser bar 2 is biased by a spring 4 towards a lowered position of the presser bar 2. On the front side of the machine housing 1, an operating lever 6 is arranged depicted here schematically as an angle lever pivotable about a fulcrum 5.

The operating lever 6 is connected by way of a linkage 7 to a shorter arm **9*a* of a double lever 9 extending along a pedestal arm toward the pedestal head and being mounted at a pivot 8 to be pivotable in a vertical plane. The longer arm 9*b* of the double lever 9 ends in a forwardly angled crosspiece 9*c* extending underneath an abutment collar 10 of the presser bar 2. A guide arm 11 is supported on the end of arm 9*a* lying directly behind the articulation point of the linkage 7. The free end of the guide arm 11 carries an index pin 12 movably guided in a vertical plane in an inherently closed can route 13 fixed in place below the double lever 9 on a pedestal wall 1***a*.

The cam 13, constituting part of a releasable locking mechanism for the lifted presser mechanism 3, if formed by a groove provided on the rear side of a plate 14 affixed to the pedestal wall 1*a*. This cam 13 has an approximately parallelogram-shaped configuration. As can be seen, in particular, from FIG. 4, the two sections 15*a*, 15*c* of the cam, which correspond to the shorter sides of the parallelogram, extend appropriately vertically. The vertical cam section 15*a* lying at a higher level terminates in an upper ingress opening 17 for the index pin 12 in the upper cam corner 16*a* between sections 15*a*, 15*d*, corresponding to the lowered position of the presser mechanism. The lower cam section 15*b* extends, under an average acute angle of inclination to the horizontal of, for example, about 30°, from section 15*a* to the turning corner 16*b* between sections 15*b*, 15*c* corresponding to the highest possible presser mechanism position. Of course, the cam route corners are rounded to ensure an unhindered passage of the index pin 12.

Figure 4:
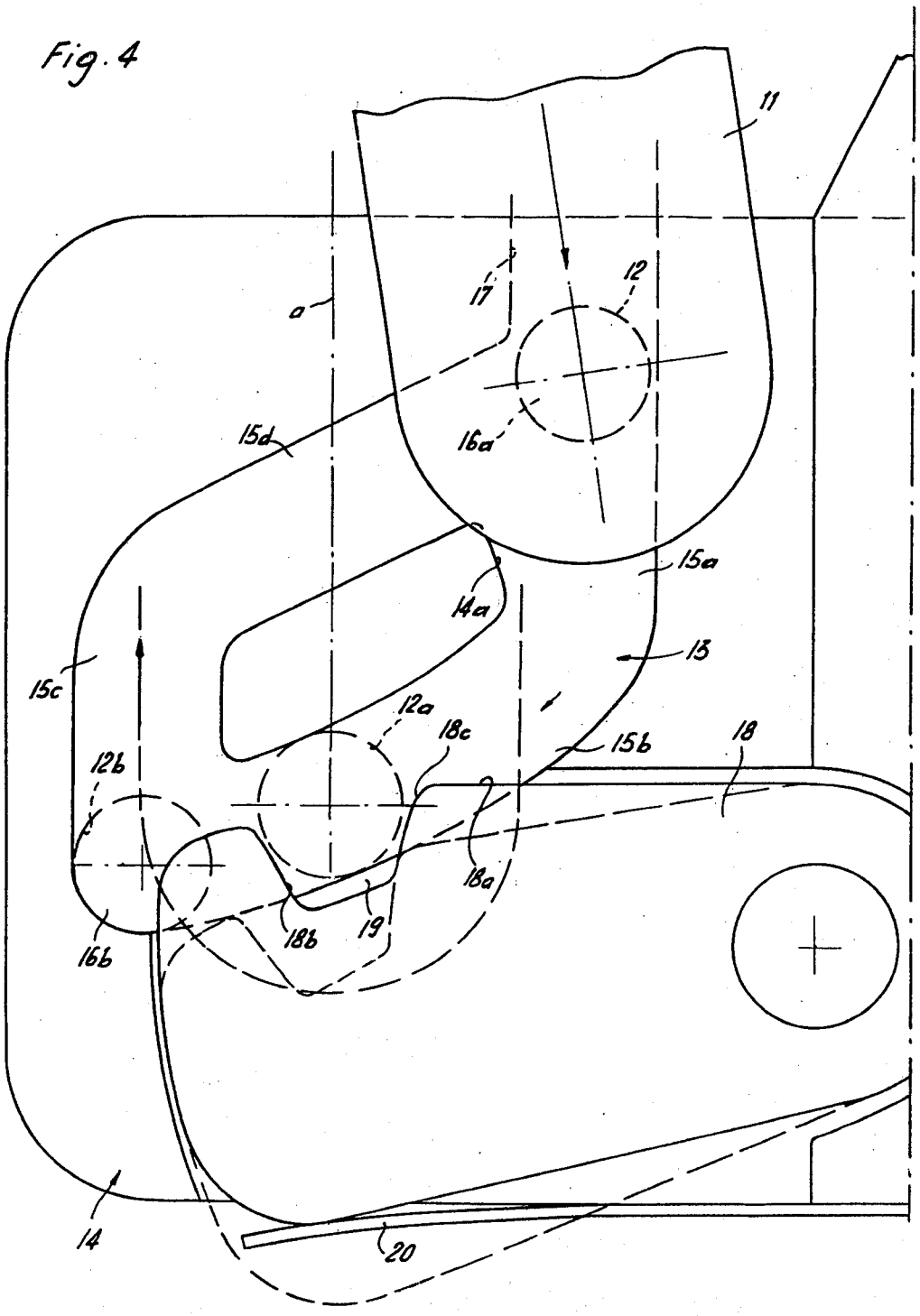
FIG. 4 shows on an enlarged scale a view taken in the direction of arrow X in FIG. 3, illustrating the locking mechanism.

As can be seen from FIG. 4, the inner wall 14*a* of the cam section 15*a* is furthermore inclined with respect to the ingress opening 17 so that, by a funneling effect, a secure entrance of the index member 12 into the cam section 15*a* is ensured. Below the cam route 13, a swivel arm 18 is provided which is mounted to the plate 14 so that it is pivotable within limits in a vertical plane. The swivel arm 18 is formed with an edge cutout 19 of approximately trapezoidal shape, serving as the detent catch for the index pin 12. A leaf spring 20 affixed to the plate 14 maintains the swivel arm 18 normally in a position wherein the detent catch 19 projects from below, relatively close to the cam corner 16*b*, into the path of motion of the index pin 12 determined by the cam section 15*b*. The bearing point of the swivel arm 18 lies below the cam 13 and at a lateral spacing from the higher-positioned cam section 15*a* in such a way that the swivel arm 18 extends approximately horizontally with the detent catch 19 projecting into the path of motion of the index pin 12.

In more detail, the arrangement is such that the guide arm 11, with respect to the vertical axis a through its point of articulation to the lever arm 9*a*, is inclined by an acute angle toward one side when the index pin is in the upper, acute-angled cam corner 16*a*, and is inclined by an acute angle toward the other side when the index pin 12 is in the lower, acute-angled cam corner 16*b*, while this guide arm extends approximately vertically, as indicated at 12*a*, when the index member lies in the detent catch 19.

The mode of operation of the above-described control device is as follows, assuming that the presser mechanism 3 is in its lowered, operative position, and the elements operatively connected therewith are in the position as shown in FIG. 1. An initial actuation of the operating lever 6 in the direction of arrow A in FIG. 1 effects, via the linkage 7, a pivoting of the double lever 9 about its bearing point 8 in the direction of arrow B. During this step, the crosspiece 9*c*, subtending the collar 10, lifts the presser bar 2 and thus the presser mechanism 3 against the bias of the spring 4.

Due to the corresponding downward movement of the guide arm 11, the index pin 12 follows the cam sections 15*a*, 15*b* (in the clockwise direction in FIG. 4) and there encounters the surface 18*a* of the swivel arm 18 projecting into its path of motion and acting as an abutment ramp. The swivel arm 18 is thereby urged, against the effect of the spring 20, downwardly into the position indicated by dashed lines in FIG. 4 to such an extent that the index pin can proceed into the position shown at 12*a* in FIG. 4. Since the swivel arm 18 is released upon entrance of the index member 12 into the zone of the detent catch 19 and is pressed again upwardly into its starting position by the spring 20, the relatively steep frontal flank 18*b* of the detent catch 19 retains the index pin in position 12*a* as long as there is no additional pressure being exerted on the operating lever 6. If now the operating lever 6 is released, the rearward flank 18*c* of the detent catch 19 prevents sliding back of the index pin 12 in the cam route 13. It is understood that the force of the spring 4 is chosen so that it is incapable of overcoming, by way of the double lever 9 and the guide arm 11, the force of the spring 20 acting on the swivel arm 18, which force retains the index pin 12 in the detent catch 19, when the operating lever 6 is released. Thus, the presser mechanism is arrested in the corresponding lifting position.

Additional pressure on the operating lever 6 in the direction of arrow A suffices for releasing the locking action without previously moving the operating lever 6 backwards. By such additional pressure and a corresponding further pivoting of the double lever 9 in the direction of arrow B, the index pin 12 is capable of overcoming the force of spring 20 by exerting corresponding pressure on the forward flank 18*b* of the detent catch 19. The swivel arm 18 yields in the downward direction and releases the index pin 12 so that the latter can be moved further into the lowermost cam corner 16*b*. As long as pressure is maintained on the operating lever 6, the index pin 12 remains in the lowermost position indicated at 12*b* in FIG. 4 while the presser mechanism 3 assumes the corresponding maximum possible lifting position.

Figure 2:
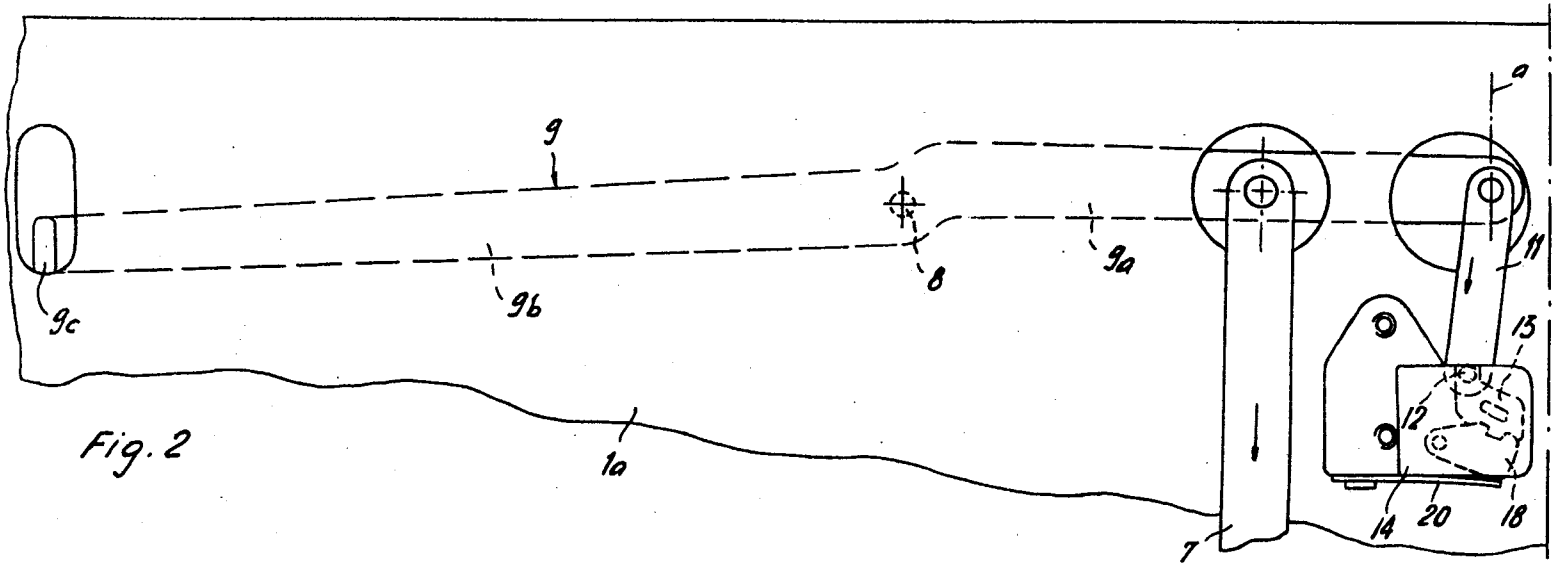
FIG. 2 shows on an enlarged scale and in a frontal view an example for the control device of FIG. 1.
Figure 3:
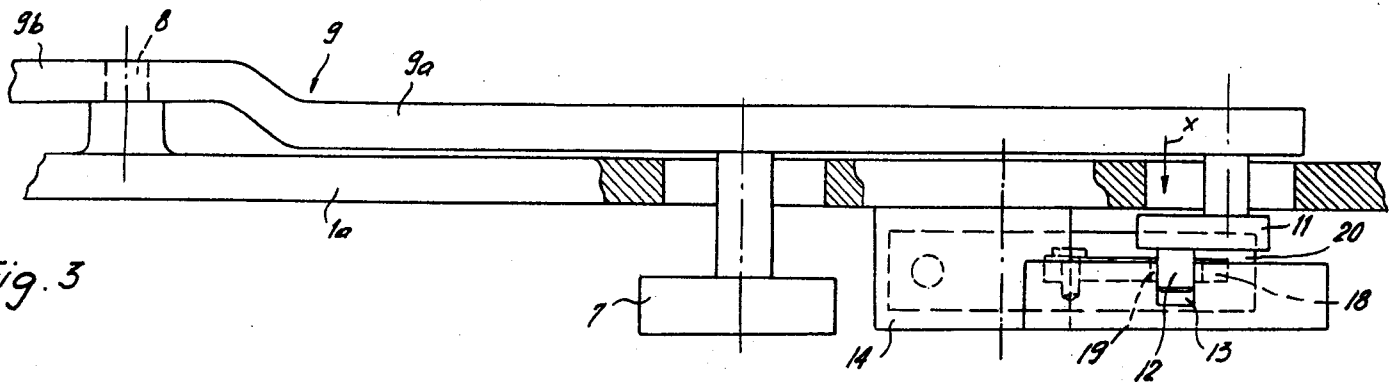
FIG. 3 shows on an enlarged scale a top view, partially in section, of the illustration of FIG. 2.

As can be seen from FIGS. 2 and 4, the difference in height of the two index pin positions 12*a* and 12*b* is very small, thanks to the relatively short cam section, only slightly inclined with respect to the horizontal, between the two positions. The level difference between the upper locking position and the maximum possible lifting position of the presser mechanism 3 is correspondingly small as well. If the operating lever 6 is then released again, the spring 4, acting on the presser bar 2 along the lines of lowering the presser mechanism 3, is capable of pivoting the double lever 9 against the direction of arrow B. During this step the guide arm 11 pulls the index pin 12, supported by the spring 20 urging the swivel arm 18 upwardly, in the upward direction in cam sections 15*c*, 15*d* toward its initial position in the upper cam corner 16*a*. The presser mechanism 3 thus resumes its lowered operating position.

It can be seen from the above that, by vigorous pressure on the operating lever 6 in the direction of arrow A, the index pin 12 can also be placed directly into the lower final position 12*b* and maintained therein as long as desired by maintaining pressure on the operating lever 6. In other words, the locking position of the index pin in the detent catch 19 of the swivel arm 18 can be passed without first having to release the operating lever 6 in the locked position of the index pin and having to move the lever backwards by a certain amount toward the starting position. On the other hand, a relatively gentle manipulation of the operating lever 6 until the front flank 18*b* of the detent catch 19 presents noticeable resistance under the action of the spring 20 to the index pin, which is reaching position 12*a*, is sufficient for locking the presser mechanism 3 in the corresponding lifted position. Since this lockable lifted position lies very close to the maximum possible lifting position of the presser mechanism 3, even very thick sewing material can be manipulated without any difficulties.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A control device for a presser mechanism of a sewing machine comprising:

an operating lever activatable in a predetermined direction for lifting and lowering the presser mechanism;

a presser bar;

a double lever;

said operating lever being operatively connected to the presser bar via said double lever;

a releasable locking mechanism including an index member guided in an inherently closed, controlled cam route and being operatively engageable with a detent catch;

said detent catch being operatively connected to a spring-loaded swivel arm and projecting into the path of movement of the index member directly in front of a turning point of the cam route corresponding to the maximum possible lifting position of the presser mechanism;

actuating of the operating lever in a first direction for lifting the presser mechanism positions said detent catch to receive and seize the index member guided through the cam route for the purpose of locking the presser mechanism in the corresponding lifted position;

a further movement of the operating lever in the first direction overcomes the spring force acting on the swivel arm and releases said index member from the detent catch toward the turning point of the cam route and, during the subsequent release of the operating lever, the index member returns automatically to a cam point corresponding to the lowered position of the presser mechanism.

2. A control device according to claim 1, wherein said double lever is pivotable in a vertical plane and includes a first arm operatively connected to said presser bar and a second arm operatively connected to said operating lever and further including a guide arm being connected to said index member and being articulated to said second arm.

3. A control device according to claim 2, wherein the cam route is in the shape of a parallelogram with two vertical sections and two sections acutely inclined toward the horizontal, with said presser mechanism being in the lowered position said index member is positioned in an upper cam corner formed by higher positioned cam sections and, with said presser mechanism being in a maximum lifted position, said index member is positioned in a lower cam corner formed by lower positioned cam sections when said index member is locked in the detent catch, the index member is in the zone of the lower, inclined cam section proximate to the lower cam corner.

4. A control device according to claim 3, wherein the detent catch is constituted by an approximately trapezoidal upper rim cutout at the swivel arm, said swivel arm being pivotable beneath the cam route in a vertical plane and being biased by a spring urging the swivel arm upwardly.

5. A control device according to claim 4, wherein the pivot bearing of the swivel arm is arranged on the side of the said upper cam corner of the cam route below and at a lateral spacing from the higher positioned vertical cam section so that the swivel arm, with the detent catch projecting into the path of motion of the index member, is in an approximately horizontal position.

* * * * *

UNITED STATES PATENT AND TRADEMARK OFFICE

CERTIFICATE OF CORRECTION

PATENT NO. : 4,466,369

DATED : August 21, 1984

INVENTOR(S) : Ernst DREIER

It is certified that error appears in the above-identified patent and that said Letters Patent is hereby corrected as shown below:

IN THE HEADING OF THE PATENT:

In Section [73] change "Akteingesellschaft" to --Aktiengesellschaft--. In Section [56] column 2 change "Kalasch" to --Kolasch--.

Signed and Sealed this

*Seventh* Day of *May 1985*

[SEAL]

*Attest:*

DONALD J. QUIGG

*Attesting Officer* *Acting Commissioner of Patents and Trademarks*